US010475394B2

(12) United States Patent
Chen

(10) Patent No.: US 10,475,394 B2
(45) Date of Patent: Nov. 12, 2019

(54) DRIVING METHOD AND DRIVING DEVICE FOR LIQUID CRYSTAL DISPLAY, AND LIQUID CRYSTAL DISPLAY

(71) Applicants: HKC Corporation Limited, Shenzhen, Guangdong (CN); Chongqing HKC Optoelectronics Technology Co.,ltd., Chongqing (CN)

(72) Inventor: Yu-Jen Chen, Shenzhen (CN)

(73) Assignees: HKC Corporation Limited, Shenzhen, Guangdong (CN); Chongqing HKC Optoelectronics Technology Co.,ltd., Chongqing (CN)

( * ) Notice: Subject to any disclaimer, the term of this patent is extended or adjusted under 35 U.S.C. 154(b) by 109 days.

(21) Appl. No.: 15/838,304

(22) Filed: Dec. 11, 2017

(65) Prior Publication Data

US 2018/0182308 A1 Jun. 28, 2018

Related U.S. Application Data

(63) Continuation of application No. PCT/CN2017/083745, filed on May 10, 2017.

(30) Foreign Application Priority Data

Dec. 23, 2016 (CN) ..... 2016 1 1215645

(51) Int. Cl.
*G09G 3/36* (2006.01)
*G09G 3/34* (2006.01)

(52) U.S. Cl.
CPC ..... *G09G 3/3413* (2013.01); *G09G 3/3648* (2013.01); *G09G 3/3607* (2013.01); *G09G 2320/0242* (2013.01); *G09G 2320/0646* (2013.01)

(58) Field of Classification Search
CPC ..... G09G 3/36–3696; G09G 2320/00–106; G09G 2300/00–0895; G09G 2310/00–08
See application file for complete search history.

(56) References Cited

U.S. PATENT DOCUMENTS

2008/0136846 A1* 6/2008 Abe ..... G09G 3/3685 345/690
2017/0206859 A1* 7/2017 Jun ..... G09G 5/10
2017/0345377 A1* 11/2017 Oh ..... G09G 3/3291

FOREIGN PATENT DOCUMENTS

CN 101009083 8/2007

* cited by examiner

*Primary Examiner* — Sanghyuk Park
(74) *Attorney, Agent, or Firm* — Winston Hsu

(57) ABSTRACT

A driving method for a liquid crystal display includes following steps: first sub-pixels are divided into array blocks, and at least one of the first sub-pixels is selected as a glowing pixel; an image to be displayed is received, a pixel signal of a liquid crystal pixel is acquired, and a high voltage panel driving signal and a low voltage panel driving signal of each first sub-pixel are achieved by looking up a table for the liquid crystal pixel; a high luminance signal and a low luminance signal for driving the glowing pixel are calculated according to the high voltage panel driving signal and the low voltage panel driving signal of the first sub-pixel in one array block, respectively; the glowing pixel are driven in turn by the high luminance signal and the low luminance signal, and the other first sub-pixels are driven by the pixel signal.

20 Claims, 5 Drawing Sheets

| | | | | | | | | |
|---|---|---|---|---|---|---|---|---|
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |

FIG. 3

| | | | | | | | | |
|---|---|---|---|---|---|---|---|---|
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |

FIG. 4

| | | | | | | | | |
|---|---|---|---|---|---|---|---|---|
| L | R | L | R | L | R | L | R | L |
| R | L | R | L | R | L | R | L | R |
| L | R | L | R | L | R | L | R | L |
| R | L | R | L | R | L | R | L | R |
| L | R | L | R | L | R | L | R | L |
| R | L | R | L | R | L | R | L | R |
| L | R | L | R | L | R | L | R | L |
| R | L | R | L | R | L | R | L | R |
| L | R | L | R | L | R | L | R | L |

FIG. 5

| | | | | | | | | |
|---|---|---|---|---|---|---|---|---|
| H | R | H | R | H | R | H | R | H |
| R | H | R | H | R | H | R | H | R |
| H | R | H | R | H | R | H | R | H |
| R | H | R | H | R | H | R | H | R |
| H | R | H | R | H | R | H | R | H |
| R | H | R | H | R | H | R | H | R |
| H | R | H | R | H | R | H | R | H |
| R | H | R | H | R | H | R | H | R |
| H | R | H | R | H | R | H | R | H |

FIG. 6

| | | | | | | | | |
|---|---|---|---|---|---|---|---|---|
| R | R | R | R | R | R | R | R | R |
| R | L | R | L | R | L | R | L | R |
| R | R | R | R | R | R | R | R | R |
| R | L | R | L | R | L | R | L | R |
| R | R | R | R | R | R | R | R | R |
| R | L | R | L | R | L | R | L | R |
| R | R | R | R | R | R | R | R | R |
| R | L | R | L | R | L | R | L | R |
| R | R | R | R | R | R | R | R | R |

FIG. 7

| | | | | | | | | |
|---|---|---|---|---|---|---|---|---|
| R | R | R | R | R | R | R | R | R |
| R | H | R | H | R | H | R | H | R |
| R | R | R | R | R | R | R | R | R |
| R | H | R | H | R | H | R | H | R |
| R | R | R | R | R | R | R | R | R |
| R | H | R | H | R | H | R | H | R |
| R | R | R | R | R | R | R | R | R |
| R | H | R | H | R | H | R | H | R |
| R | R | R | R | R | R | R | R | R |

FIG. 8

| | | | | | | | | |
|---|---|---|---|---|---|---|---|---|
| R | R | R | R | R | R | R | R | R |
| R | L | R | R | L | R | R | L | R |
| R | R | R | R | R | R | R | R | R |
| R | R | R | R | R | R | R | R | R |
| R | L | R | R | L | R | R | L | R |
| R | R | R | R | R | R | R | R | R |
| R | R | R | R | R | R | R | R | R |
| R | L | R | R | L | R | R | L | R |
| R | R | R | R | R | R | R | R | R |

FIG. 9

| | | | | | | | | |
|---|---|---|---|---|---|---|---|---|
| R | R | R | R | R | R | R | R | R |
| R | H | R | R | H | R | R | H | R |
| R | R | R | R | R | R | R | R | R |
| R | R | R | R | R | R | R | R | R |
| R | H | R | R | H | R | R | H | R |
| R | R | R | R | R | R | R | R | R |
| R | R | R | R | R | R | R | R | R |
| R | H | R | R | H | R | R | H | R |
| R | R | R | R | R | R | R | R | R |

FIG. 10

| | | | | | | | | |
|---|---|---|---|---|---|---|---|---|
| L1 | L2 | L3 | L | L | L | L | L | L |
| L4 | L5 | L6 | L | L | L | L | L | L |
| L7 | L8 | L9 | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |

FIG. 11

| | | | | | | | | |
|---|---|---|---|---|---|---|---|---|
| H1 | H2 | H3 | H | H | H | H | H | H |
| H4 | H5 | H6 | H | H | H | H | H | H |
| H7 | H8 | H9 | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |

| | | | | | | | | |
|---|---|---|---|---|---|---|---|---|
| 0.4 | 0.8 | 0.4 | 0.4 | 0.8 | 0.4 | 0.4 | 0.8 | 0.4 |
| 0.8 | 1 | 0.8 | 0.8 | 1 | 0.8 | 0.8 | 1 | 0.8 |
| 0.4 | 0.8 | 0.4 | 0.4 | 0.8 | 0.4 | 0.4 | 0.8 | 0.4 |
| 0.4 | 0.8 | 0.4 | 0.4 | 0.8 | 0.4 | 0.4 | 0.8 | 0.4 |
| 0.8 | 1 | 0.8 | 0.8 | 1 | 0.8 | 0.8 | 1 | 0.8 |
| 0.4 | 0.8 | 0.4 | 0.4 | 0.8 | 0.4 | 0.4 | 0.8 | 0.4 |
| 0.4 | 0.8 | 0.4 | 0.4 | 0.8 | 0.4 | 0.4 | 0.8 | 0.4 |
| 0.8 | 1 | 0.8 | 0.8 | 1 | 0.8 | 0.8 | 1 | 0.8 |
| 0.4 | 0.8 | 0.4 | 0.4 | 0.8 | 0.4 | 0.4 | 0.8 | 0.4 |

DRIVING METHOD AND DRIVING DEVICE FOR LIQUID CRYSTAL DISPLAY, AND LIQUID CRYSTAL DISPLAY

CROSS REFERENCE TO RELATED APPLICATIONS

This application is a continuation of PCT/CN2017/083745 filed on May 10, 2017, entitled "DRIVING METHOD FOR LIQUID CRYSTAL DISPLAY, DRIVING DEVICE OF LIQUID CRYSTAL DISPLAY, AND LIQUID CRYSTAL DISPLAY", and the entire contents of which is hereby incorporated by reference.

BACKGROUND OF THE DISCLOSURE

1. Field of the Disclosure

The present disclosure relates to the field of liquid crystal panel display technique, and in particular, to a driving method for a liquid crystal display, a driving device of the liquid crystal display and the liquid crystal display.

2. Description of the Prior Art

The existing large scale liquid crystal display panel mostly adopts negative-type vertical alignment liquid crystal technology or in-plane switching liquid crystal technology, compared with the in-plane switching liquid crystal technology, the vertical alignment liquid crystal technology has the advantages of higher production efficiency and lower manufacturing cost, while on the optical property, the vertical alignment liquid crystal technology has an obvious optical property defect compared with the in-plane switching liquid crystal technology, especially the large scale panel needs to present a larger viewable angle in business applications, when the liquid crystal display panel is driven by the vertical alignment liquid crystal, the vertical alignment liquid crystal may occur viewable angle color aberration, causing that the vertical alignment liquid crystal often cannot meet the requirements of market application, which affects the promotion of the vertical alignment liquid crystal technology.

The vertical alignment liquid crystal technology normally divides each base color of RGB into primary pixels and secondary pixels again, and gives the primary pixels and secondary pixels different driving voltages on the space to solve the viewable angle color aberration defect, the design of the pixels normally needs a metal running line or a thin-film transistor element to drive the secondary pixels, which causes the reduce of the permeable opening area, and affects the penetration rate of panel, and directly improves the cost of the backlight module.

SUMMARY OF THE DISCLOSURE

The present disclosure provides a method for driving a liquid crystal display executed by a computing device, which can reduce viewable angle color aberration, simultaneously improve the penetration rate of panel and reduce the cost of the backlight module.

A method for driving a liquid crystal display executed by a computing device provided by the present disclosure, includes the following steps:

dividing first sub-pixels of a display panel into a plurality of array blocks by a processor, and selecting at least one of the first sub-pixels in each array block as a glowing pixel;

receiving an image to be displayed, and acquiring a pixel signal of a liquid crystal pixel of the display panel, and looking up a table for the liquid crystal pixel, so as to obtain a high voltage panel driving signal and a low voltage panel driving signal of the first sub-pixel;

calculating a high luminance signal and a low luminance signal, respectively, for driving the glowing pixel in the array block according to the high voltage panel driving signal and the low voltage panel driving signal of the first sub-pixel in each array block; and driving the glowing pixels in turn by the high luminance signal and the low luminance signal, and driving the other first sub-pixels by the pixel signal.

In an exemplary embodiment, relative positions between the glowing pixel and the other first sub-pixels in each array block are the same.

In an exemplary embodiment, the step of dividing the first sub-pixels of the display panel into the plurality of array blocks by the processor, and selecting the at least one of the first sub-pixels in each array block as the glowing pixel includes:

defining adjacent two of the first sub-pixels as a block, and selecting any one of the two adjacent first sub-pixels in the block as the glowing pixel.

In an exemplary embodiment, the step of dividing the first sub-pixels of the display panel into the plurality of array blocks by the processor, and selecting the at least one of the first sub-pixels in each array block as the glowing pixel includes:

defining adjacent four of the first sub-pixels as a block, and selecting any one of the four adjacent first sub-pixels in the block as the glowing pixel.

In an exemplary embodiment, the step of dividing the first sub-pixels of the display panel into the plurality of array blocks by the processor, and selecting the at least one of the first sub-pixels in each array block as the glowing pixel includes:

defining adjacent nine of the first sub-pixels as a block, and selecting one first sub-pixel located at the center of the block as the glowing pixel.

In an exemplary embodiment, adopting following formulas to calculate the high luminance signal and the low luminance signal for driving the glowing pixel in the array block according to the low voltage panel driving signal of the first sub-pixel in each array block:

$$L=1*L5+0.8*(L2+L4+L6+L8)+0.4*(L1+L3+L7+L9);$$

$$H=1*H5+0.8*(H2+H4+H6+H8)+0.4*(H1+H3+H7+H9);$$

wherein, L1, L3, L7, L9 represent four first sub-pixels' low voltage panel driving signals which are in the diagonal positions;

L2, L4, L6, L8 represent another four first sub-pixels' low voltage panel driving signals which are adjacent to the first sub-pixel located at the center of the block;

H1, H3, H7, H9 represent four first sub-pixels' high voltage panel driving signals which are in the diagonal positions;

H2, H4, H6, H8 represent another four first sub-pixels' high voltage panel driving signals which are adjacent to the first sub-pixel located at the center of the block;

L5 represents the glowing pixel's low voltage panel driving signal, L represents the low luminance signal which needs to be calculated;

H5 represents the glowing pixel's high voltage panel driving signal, H represents the high luminance signal which needs to be calculated.

The present disclosure provides a driving device of a liquid crystal display, the driving device includes a processor and a nonvolatile memorizer, the nonvolatile memorizer stores executable instructions, the processor executes the executable instructions, and the executable instructions includes:

a block dividing module: used for dividing first sub-pixels of a display panel into a plurality of array blocks, and selecting at least one of the first sub-pixels in each array block as a glowing pixel;

a signal acquiring module: used for receiving an image to be displayed, and acquiring a pixel signal of a liquid crystal pixel of the display panel, and looking up a table for the liquid crystal pixel, so as to obtain a high voltage panel driving signal and a low voltage panel driving signal of the first sub-pixel of each pixel;

a calculating module: used for calculating a high luminance signal and a low luminance signal, respectively, for driving the glowing pixel in the array block according to the high voltage panel driving signal and the low voltage panel driving signal of the first sub-pixel in each array block; and a driving module: used for driving the glowing pixels in turn by the high luminance signal and the low luminance signal, and driving the other first sub-pixels by the pixel signal.

In an exemplary embodiment, relative positions between the glowing pixel and the other first sub-pixels in each array block are the same.

In an exemplary embodiment, the block dividing module defines adjacent two of the first sub-pixels as a block, and selects any one of the two adjacent first sub-pixels in the block as the glowing pixel.

The present disclosure also provides a liquid crystal display, the liquid crystal display includes the driving device of the liquid crystal display as described above.

The present disclosure divides the first sub-pixels of the display panel into the plurality of blocks, the blocks are arrayed, and selects at least one of the first sub-pixels in each array block as a glowing pixel for compensating color aberration; then acquires the high voltage panel driving signal and the low voltage panel driving signal of the first sub-pixel from the received image, the high voltage panel driving signal and the low voltage panel driving signal are preset, and can be acquired by looking up the table when needed; calculates the high luminance signal and the low luminance signal, respectively, for driving the glowing pixel according to the high voltage panel driving signal and the low voltage panel driving signal of the first sub-pixel, and drives the glowing pixel by adopting the high luminance signal and the low luminance signal in turn, and the other first sub-pixels in the same block are still driven by pixel signal. The viewable angle color aberration can be reduced by driving the glowing pixel through the high luminance signal and the low luminance signal in turn, in addition the technical proposal of the present disclosure does not need to set primary pixels and secondary pixels on the panel, and does not need to design a metal running line and a thin-film transistor element to drive the secondary pixels, the manufacturing process is simplified, the cost is reduced, simultaneously as the secondary pixels are omitted, the penetration rate of panel is improved.

BRIEF DESCRIPTION OF THE DRAWINGS

To illustrate the exemplary embodiments of the present disclosure or the technical proposal of the prior art more clearly, the accompanying drawings for describing the exemplary embodiments or the prior art are introduced briefly in the following, apparently, the accompanying drawings in the following description are only about some embodiments of the present invention, and persons of ordinary skill in the art can derive other drawings from the steps shown in the accompanying drawings without creative efforts.

FIG. 3 is a distribution diagram of a high voltage panel signal when using two frames to display an image;

FIG. 4 is a distribution diagram of a low voltage panel signal when using two frames to display an image;

FIG. 5 is a diagram of a glowing pixel settled according to the block and adopting a low voltage panel driving signal according to an exemplary embodiment;

FIG. 6 is a diagram of a glowing pixel settled according to the block and adopting a high voltage panel driving signal according to an exemplary embodiment;

FIG. 7 is a diagram of the glowing pixel settled according to the block and adopting the low voltage panel driving signal according to another exemplary embodiment;

FIG. 8 is a diagram of the glowing pixel settled according to the block and adopting the high voltage panel driving signal according to another exemplary embodiment;

FIG. 9 is a diagram of the glowing pixel settled according to the block and adopting the low voltage panel driving signal according to a third exemplary embodiment;

FIG. 10 is a diagram of the glowing pixel settled according to the block and adopting the high voltage panel driving signal according to a third exemplary embodiment;

FIG. 11 is a diagram of a relative position between the glowing pixel adopting the low voltage panel driving signal and the first sub-pixel in one block shown in FIG. 9;

The realizing of the aim, functional characteristics, advantages of the present disclosure are further described in detail with reference to the accompanying drawings and the embodiments.

DETAILED DESCRIPTION

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present invention without creative efforts shall fall within the protection scope of the present invention.

It is to be understood that, all of the directional instructions in the exemplary embodiments of the present disclosure (such as top, down, left, right, front, back . . . ) can only be used for explaining relative position relations, moving condition of the elements under a special form (referring to figures), and so on, if the special form changes, the directional instructions changes accordingly.

In addition, the descriptions, such as the "first", the "second" in the present disclosure, can only be used for describing the aim of description, and cannot be understood as indicating or suggesting relative importance or impliedly indicating the number of the indicated technical character. Therefore, the character indicated by the "first", the "second" can express or impliedly include at least one character. In addition, the technical proposal of each exemplary embodiment can be combined with each other, however the technical proposal must base on that the ordinary skill in that art can realize the technical proposal, when the combination of the technical proposals occurs contradiction or cannot realize, it should consider that the combination of the technical proposals does not existed, and is not contained in the protection scope required by the present disclosure.

The present disclosure provides a driving method for a liquid crystal display.

Figure 1:
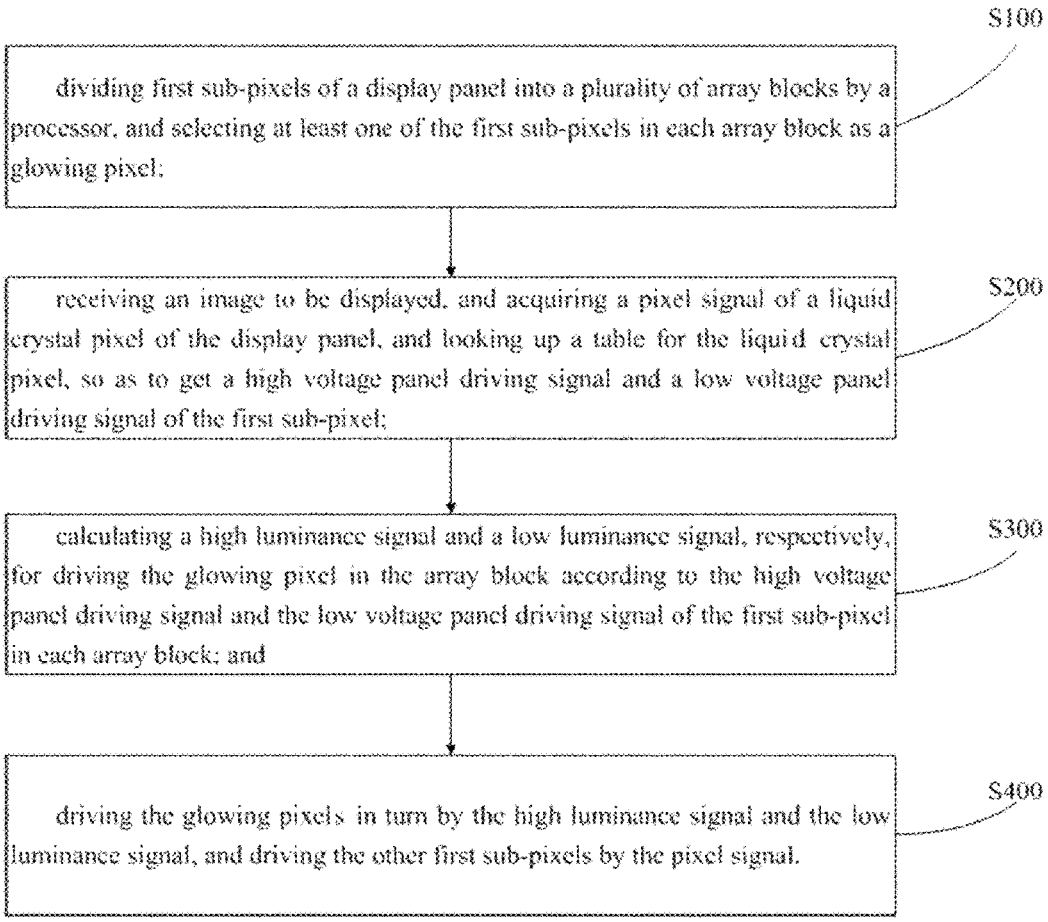
FIG. 1 is a flowchart of a driving method for a liquid crystal display of the present disclosure according to an exemplary embodiment.

Referring to FIG. 1, in an exemplary embodiment of the present disclosure, the driving method for the liquid crystal display, includes the following steps:

S100, first sub-pixels of a display panel are divided into a plurality of array blocks by a processor, and at least one of the first sub-pixels in each array block is selected as a glowing pixel;

S200, an image to be displayed is received, a pixel signal of a liquid crystal pixel of the display panel is acquired, and a high voltage panel driving signal and a low voltage panel driving signal of the first sub-pixel is achieved by looking up a table for the liquid crystal pixel;

S300, a high luminance signal and a low luminance signal for driving the glowing pixel in the array block are calculated, respectively, according to the high voltage panel driving signal and the low voltage panel driving signal of the first sub-pixel in each array block;

S400, the glowing pixel are driven in turn by the high luminance signal and the low luminance signal, and the other first sub-pixels are driven by the pixel signal.

It is to be noted that, the driving signal of the liquid crystal display in existing technology is driven in turn by a high voltage signal and a low voltage signal along with image frames.

Figure 2:
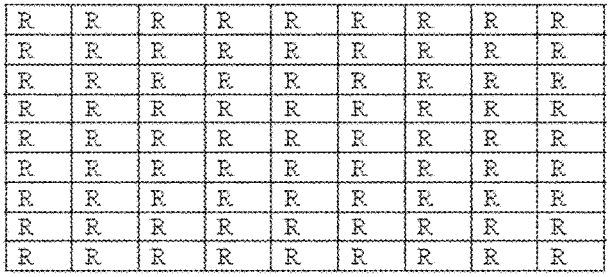
FIG. 2 is a distribution diagram of a first pixel signal when using a frame to display an image.

Wherein, FIG. 2 uses a frame to display an image, R represents adopting the pixel signal to drive corresponding sub-pixel.

FIG. 3 and FIG. 4 represent adopting two frames to display an image, H in FIG. 3 represents adopting high voltage panel driving signal to drive corresponding sub-pixel, and L in FIG. 4 represents adopting low voltage panel driving signal to drive corresponding sub-pixel.

The high voltage panel driving signal RH/GH/BH and the low voltage panel driving signal RL/GL/BL, can be a preset high voltage signal and a preset low voltage signal according to an inputting signal of RGB, which can be determined according to a perspective effect needed to be compensated, relevant data are burned to the liquid crystal display when the liquid crystal display is produced. The data are normally recorded in a hardware circular buffer through a LUT (Look Up Table) mode, for 8 bit driving signal, each R/G/B inputting signal inputs 0~255, totally corresponds to 256 high and low voltage signals, there are 3*256 pairs of high voltage signals RH/GH/BH and low voltage signals RL/GL/BL. Therefore, the needed low voltage panel driving signal and high voltage panel driving signal are achieved.

In the liquid crystal display, the display effect of the liquid crystal can be determined by the commonly driving of the panel driving signal and the luminance signal of backlight. In the exemplary embodiment, the luminance signal of the backlight does not change, the panel driving signal can be adjusted.

The present disclosure divides first sub-pixels of the display panel into the plurality of blocks, the blocks are arrayed, and selected at least one of the glowing pixels used for compensating color aberration from the same position of each block first sub-pixel in each array block as a glowing pixel; then acquires the high voltage panel driving signal and the low voltage panel driving signal of the first sub-pixel from the received image, the high voltage panel driving signal and the low voltage panel driving signal are preset, and can be acquired by looking up the table when needed; respectively calculates the high luminance signal and the low luminance signal for driving the glowing pixel according to the high voltage panel driving signal and the low voltage panel driving signal of the first sub-pixel, and drives the glowing pixel by adopting the high luminance signal and the low luminance signal in turn, the other first sub-pixels in the same block are still driven by pixel signal. The viewable angle color aberration can be reduced by driving the glowing pixel through the high luminance signal and the low luminance signal in turn, in addition the technical proposal of the present disclosure does not need to set primary pixels and secondary pixels on the panel, and does not need to design metal running line and thin-film transistor element to drive the secondary pixels, the manufacturing process is simplified, the cost is reduced, simultaneously as the secondary pixels are omitted, the penetration rate of panel is improved.

In the exemplary embodiment, relative positions between the glowing pixel and the other first sub-pixels in each array block are the same.

In an exemplary embodiment, the step of that the display panel divides the first sub-pixels into the plurality of array blocks, and selects at least one of the first sub-pixels in the block as the glowing pixel includes:

adjacent two of the first sub-pixels are defined as a block, any one of the two adjacent first sub-pixels in the block is selected as the glowing pixel.

In FIG. 5 and FIG. 6, L represents the low voltage panel driving signal, H represents the high voltage panel driving signal, R represents directly adopting the pixel signal to drive. In the exemplary embodiment of the present disclosure, the glowing pixel can be driven by L and H in turn simultaneously, the other first sub-pixels of the display panel can be driven by R, and two frames can be used to display an image.

Here, adjacent two of the first sub-pixel in the horizontal direction can be defined as a block, and the hole display panel can be divided into the plurality of block arrays. The first sub-pixels in the blocks located at the same positions can be defined as the glowing pixels. According to two sub-pixels' low voltage panel driving signals and high voltage panel driving signals, the high luminance signal and the low luminance signal of the glowing pixel can be respectively calculated. Then the two types of the pixels can be driven by adopting the high luminance signals, the low luminance signals and the pixel signals.

In an exemplary embodiment, the step of that the display panel divides the first sub-pixels into the plurality of array blocks, and selects at least one of the first sub-pixels in the block as the glowing pixel includes:

adjacent four of the first sub-pixels are defined as a block, and selects any one of the four adjacent first sub-pixels in the block as the glowing pixel, the four adjacent first sub-pixels are respectively located at intersections of two rows and two columns.

In FIG. 7 and FIG. 8, L represents adopting low voltage panel driving signal, H represents adopting high voltage panel driving signal, R represents directly adopting pixel signal to drive. In the exemplary embodiment of the present disclosure, the glowing pixel can be driven by L and H in turn simultaneously, the other first sub-pixels of the display panel can be driven by R, two frames can be used to display an image.

Here adjacent four of the first sub-pixels are defined as one block, four adjacent first sub-pixels are respectively located at four vertexes of a structure similar to a square. The first sub-pixels in the blocks located at the same positions can be defined as the glowing pixels. According to four sub-pixels' low voltage panel driving signals and high voltage panel driving signals, the high luminance signal and the low luminance signal of the glowing pixel can be respectively calculated. Then the two types of the pixels can be driven by adopting the high luminance signals, the low luminance signals and the pixel signals.

In an exemplary embodiment, the step of that the display panel divides the first sub-pixels into the plurality of array blocks, and selects at least one of the first sub-pixels in the block as the glowing pixel includes:

adjacent nine of the first sub-pixels are defined as a block, and selects one first sub-pixel located at the center of the block as the glowing pixel, the nine adjacent first sub-pixels are respectively located at intersections of three continuous rows and three continuous columns.

In FIG. 9 and FIG. 10, L represents adopting the low voltage panel driving signal, H represents adopting high voltage panel driving signal, R represents directly adopting the pixel signal to drive. In the exemplary embodiment of the present disclosure, the glowing pixel can be driven by L and H in turn simultaneously, the other first sub-pixels of the display panel can be driven by R, and two frames can be used to display an image.

Here adjacent nine of the first sub-pixel can be defined as a block, eight of the nine adjacent first sub-pixel are respectively located at four vertexes and four sides of a structure similar to a square, the glowing pixel is located at the center of the square. The first sub-pixels in the blocks located at the same position can be defined as the glowing pixels. According to nine adjacent sub-pixels' low voltage panel driving signals and high voltage panel driving signals, the high luminance signal and the low luminance signal of the glowing pixels can be respectively calculated. Then the two types of the pixels can be respectively driven by adopting the high luminance signals, the low luminance signals and the pixel signals.

In an exemplary embodiment, the high luminance signal and the low luminance signal for driving the glowing pixel according to the low voltage panel driving signal of the first sub-pixel in one array block can be calculated according to the following formulas:

$$L=1*L5+0.8*(L2+L4+L6+L8)+0.4*(L1+L3+L7+L9);$$

$$H=1*H5+0.8*(H2+H4+H6+H8)+0.4*(H1+H3+H7+H9);$$

wherein, L1, L3, L7, L9 represent four first sub-pixels' low voltage panel driving signals which are in the diagonal positions;

L2, L4, L6, L8 represent another four first sub-pixels' low voltage panel driving signals which are adjacent to the first sub-pixel located at the center of the block;

H1, H3, H7, H9 represent four first sub-pixels' high voltage panel driving signals which are in the diagonal positions;

H2, H4, H6, H8 represent another four first sub-pixels' high voltage panel driving signals which are adjacent to the first sub-pixel located at the center of the block;

L5 represents the glowing pixel's low voltage panel driving signal, L represents the low luminance signal which needs to be calculated;

H5 represents the glowing pixel's high voltage panel driving signal, H represents the high luminance signal which needs to be calculated.

Figures 12, 13, 14:
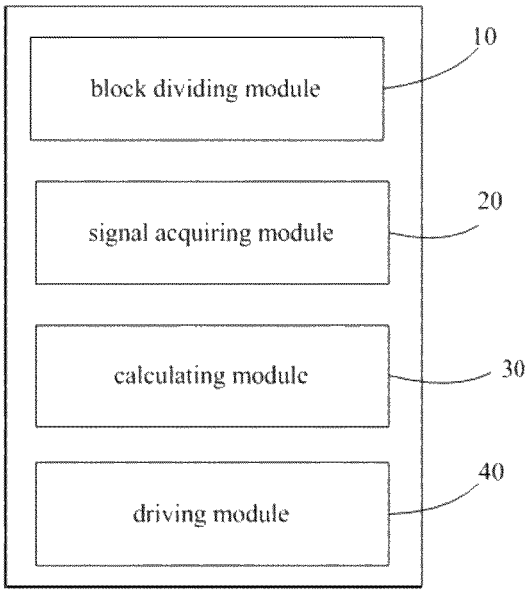
FIG. 12 is a diagram of a relative position between the glowing pixel adopting the high voltage panel driving signal and the first sub-pixel in one block shown in FIG. 9.
FIG. 13 is a diagram of a relationship of the weight ratios of the glowing pixel and another first sub-pixels according to an exemplary embodiment.
FIG. 14 is a function module diagram of a driving device of the liquid crystal display of the present disclosure according to an exemplary embodiment.

Referring to sheet and FIG. 11 and FIG. 12, sheet 10 and sheet 11 represent relative positions of L1-L9 and H1-H9 in one block, FIG. 13 represents relationships of the weight ratios of the low voltage panel driving signal and the high voltage panel driving signal of all the first sub-pixel and the high luminance signal and the low luminance signal of the glowing pixel in the same block.

It is to be noted that, the calculating of the low luminance signal is counting the compensation for the low voltage signal theoretically given from all of the sub-pixels in the unit and adjusting the weights of the influence of relevant position's real location of some sub-pixels in the unit, so that the compensation effect got by the low luminance sub-pixel signal can meet the average needed compensation effect in the unit, the adjusting of the weight can also represent a gray-scale signal of the sub-pixel which is given from the real image corresponding to the real position of the sub-pixel Taking nine sub-pixels as a unit for an example, the weight of the display position of the low luminance signal can be 1, which actually represents that the influence of the position is biggest, secondary weights of the low luminance signals located at top, down, left, right are 0.8, secondary weights of the low luminance signals located at four corners are 0.4.

Similarly, taking nine sub-pixels as a unit for an example, the weight of the display position of the high luminance signal can be 1, which actually represents that the influence of the position is biggest, secondary weights of the high luminance signals located at top, down, left, right are 0.8, secondary weights of the high luminance signals located at four corners are 0.4.

Therefore not only the real representing signal can be really reflected which should be reflected by displaying the position of the low gray-scale, but also surrounding sub-pixels can get reasonable brightness distribution.

In order to solve the defect of viewable angle color aberration of twisted nematic type thin film transistor display panel, optically compensated bend type thin film transistor display panel, vertical alignment type thin film transistor display panel, the technical proposal of the present disclosure applies straight or side backlight, white light or RGB three colors light source, cooperates panel high and low voltage panel driving signals to compensate and adjust the backlight brightness, so as to reduce a flare phenomenon caused by the differences of switching the panel high and low voltage panel driving signals. Simultaneously, the advantage of compensating the viewable angle color aberration by the high and low liquid crystal voltage can be maintained. Second, the pixel does not need to be design to primary pixel and secondary pixel, the penetration rate of thin film transistor display panel is greatly improved, the cost of the backlight is reduced. For a development of a high-resolution thin film transistor display panel, the effect of improving penetration rate and resolution is more pronounced due to that the pixel does not need to be design to primary pixel and secondary pixel.

Referring to FIG. 14, based on the above driving method for the liquid crystal display, the present disclosure also provides a driving device of the liquid crystal display, a flat-panel display, a television display screen, a computer display screen, and so on, wherein the flat-panel display can be a liquid crystal display, a plasma display, an electroluminescent display, and so on. The driving device of the liquid crystal display includes:

a block dividing module 10, is used for dividing first sub-pixels of a display panel into a plurality of array blocks, and selecting at least one of the first sub-pixels in each block as a glowing pixel;

a signal acquiring module 20, used for receiving an image to be displayed, and acquiring a pixel signal of a liquid crystal pixel of the display panel, looking up a table for the liquid crystal pixel, so as to obtain a high voltage panel driving signal and a low voltage panel driving signal of each first sub-pixel;

a calculating module 30, used for calculating a high luminance signal and a low luminance signal, respectively, for driving the glowing pixel in the array block according to the high voltage panel driving signal and the low voltage panel driving signal of the first sub-pixel in each array block; and a driving module 40, used for driving the glowing pixels in turn by the high luminance signal and the low luminance signal, and driving the other first sub-pixels by the pixel signal.

In an exemplary embodiment, the block dividing module 10 defines adjacent two of the first sub-pixels as a block, and selects any one of the two adjacent first sub-pixels in the block as the glowing pixel.

In an exemplary embodiment, the block dividing module 10 defines adjacent four of the first sub-pixels as a block, and selects any one of the four adjacent first sub-pixels in the block as the glowing pixel, the four adjacent first sub-pixels are located at intersections of two rows and two columns, respectively.

In an exemplary embodiment, the block dividing module 10 defines adjacent nine of the first sub-pixels as a block, and selects one first sub-pixel locating at the center of the block as the glowing pixel, the nine adjacent first sub-pixels are located at intersections of three continuous rows and three continuous columns, respectively.

In an exemplary embodiment, the calculating module 30 adopts the following formula to calculate the high luminance signal and the low luminance signal:

$$L=1*L5+0.8*(L2+L4+L6+L8)+0.4*(L1+L3+L7+L9);$$

$$H=1*H5+0.8*(H2+H4+H6+H8)+0.4*(H1+H3+H7+H9);$$

wherein, L1, L3, L7, L9 represent four first sub-pixels' low voltage panel driving signals which are in the diagonal positions;

L2, L4, L6, L8 represent another four first sub-pixels' low voltage panel driving signals which are adjacent to the first sub-pixel located at the center of the block;

H1, H3, H7, H9 represent four first sub-pixels' high voltage panel driving signals which are in the diagonal positions;

H2, H4, H6, H8 represent another four first sub-pixels' high voltage panel driving signals which are adjacent to the first sub-pixel located at the center of the block;

L5 represents the glowing pixel's low voltage panel driving signal, L represents the low luminance signal which needs to be calculated;

H5 represents the glowing pixel's high voltage panel driving signal, H represents the high luminance signal which needs to be calculated.

Persons of ordinary skill in the art should understand that, the present disclosure also provides a driving device of the liquid crystal display, the driving device includes a processor and a nonvolatile memorizer, the nonvolatile memorizer stores executable instructions, the processor executes the executable instructions, for realizing the methods recited in above described exemplary embodiments. Persons of ordinary skill in the art should further understand that, the module/unit 10, 20, 30, 40 shown in FIG. 14 of the present disclosure can be software modules or software units. In addition, various software modules or software units can be inherently stored in the nonvolatile memorizer and executed by the processor.

The present disclosure also provides a liquid crystal display, the liquid crystal display includes the driving device of the liquid crystal display, the detail structures of the driving device of the liquid crystal display can be referred to the above exemplary embodiments, as the liquid crystal display adopts all the technical proposal of the above exemplary embodiments, the liquid crystal display at least has all of the beneficial effects of the technical proposal of the above exemplary embodiments, no need to repeat again.

The liquid crystal display can be a tablet computer display screen, a television display screen, a computer display screen, and so on.

The embodiments above are preferably embodiments of the present disclosure, and the present disclosure is not limited to such embodiments, equivalent structure conversion based on the specification and the drawing of the present disclosure, or directly or indirectly used in other related technical field, both similarly within the protection scope of the present disclosure.

What is claimed is:

1. A method for driving a liquid crystal display executed by a computing device, comprising the following steps:

dividing first sub-pixels of a display panel into a plurality of array blocks by a processor, and selecting at least one of the first sub-pixels in each array block as a glowing pixel;

receiving an image to be displayed, and acquiring a pixel signal of a liquid crystal pixel of the display panel, and looking up a table for the liquid crystal pixel, so as to obtain a high voltage panel driving signal and a low voltage panel driving signal of the first sub-pixel;

calculating a high luminance signal and a low luminance signal, respectively, for driving the glowing pixel in the array block according to the high voltage panel driving signal and the low voltage panel driving signal of the first sub-pixel in each array block; and driving the glowing pixels in turn by the high luminance signal and the low luminance signal, and driving other first sub-pixels by the pixel signal.

2. The method according to claim 1, wherein relative positions between the glowing pixel and the other first sub-pixels in each array block are the same.

3. The method according to claim 2, wherein the step of dividing the first sub-pixels of the display panel into the plurality of array blocks by the processor, and selecting the at least one of the first sub-pixels in each array block as the glowing pixel comprises:

defining adjacent two of the first sub-pixels as one of the plurality of array blocks, and selecting any one of the two adjacent first sub-pixels in the one of the plurality of array blocks as the glowing pixel.

4. The method according to claim 2, wherein the step of dividing the first sub-pixels of the display panel into the plurality of array blocks by the processor, and selecting the at least one of the first sub-pixels in each array block as the glowing pixel comprises:

defining adjacent four of the first sub-pixels as one of the plurality of array blocks, and selecting any one of the four adjacent first sub-pixels in the one of the plurality of array blocks as the glowing pixel.

5. The method according to claim 1, wherein the step of dividing the first sub-pixels of the display panel into the plurality of array blocks by the processor, and selecting the at least one of the first sub-pixels in each array block as the glowing pixel comprises:

defining adjacent two of the first sub-pixels as one of the plurality of array blocks, and selecting any one of the two adjacent first sub-pixels in the one of the plurality of array blocks as the glowing pixel.

6. The method according to claim 1, wherein the step of dividing the first sub-pixels of the display panel into the plurality of array blocks by the processor, and selecting the at least one of the first sub-pixels in each array block as the glowing pixel comprises:

defining adjacent four of the first sub-pixels as one of the plurality of array blocks, and selecting any one of the four adjacent first sub-pixels in the one of the plurality of array blocks as the glowing pixel.

7. The method according to claim 1, wherein the step of dividing the first sub-pixels of the display panel into the plurality of array blocks by the processor, and selecting the at least one of the first sub-pixels in each array block as the glowing pixel comprises:

defining adjacent nine of the first sub-pixels as one of the plurality of array blocks, and selecting one first sub-pixel located at a center of the one of the plurality of array blocks as the glowing pixel.

8. The method according to claim 7, wherein adopting following formulas to calculate the high luminance signal and the low luminance signal for driving the glowing pixel in the array block according to the low voltage panel driving signal of the first sub-pixel in each array block:

$$L=1*L5+0.8*(L2+L4+L6+L8)+0.4*(L1+L3+L7+L9);$$

$$H=1*H5+0.8*(H2+H4+H6+H8)+0.4*(H1+H3+H7+H9);$$

wherein, L1, L3, L7, L9 represent four first sub-pixels' low voltage panel driving signals which are in the diagonal positions;

L2, L4, L6, L8 represent another four first sub-pixels' low voltage panel driving signals which are adjacent to the first sub-pixel located at a center of the one of the plurality of array blocks;

H1, H3, H7, H9 represent four first sub-pixels' high voltage panel driving signals which are in the diagonal positions;

H2, H4, H6, H8 represent another four first sub-pixels' high voltage panel driving signals which are adjacent to the first sub-pixel located at a center of the one of the plurality of array blocks;

L5 represents the glowing pixel's low voltage panel driving signal, L represents the low luminance signal which needs to be calculated;

H5 represents the glowing pixel's high voltage panel driving signal, H represents the high luminance signal which needs to be calculated.

9. A driving device of a liquid crystal display, wherein, the driving device comprises a processor and a memorizer, the memorizer stores executable instructions, the processor executes the executable instructions, and the executable instructions comprises:

a block dividing module, used for dividing first sub-pixels of a display panel into a plurality of array blocks, and selecting at least one of the first sub-pixels in each array block as a glowing pixel;

a signal acquiring module, used for receiving an image to be displayed, and acquiring a pixel signal of a liquid crystal pixel of the display panel, and looking up a table for the liquid crystal pixel, so as to obtain a high voltage panel driving signal and a low voltage panel driving signal of each first sub-pixel;

a calculating module, used for calculating a high luminance signal and a low luminance signal, respectively, for driving the glowing pixel in the array block according to the high voltage panel driving signal and the low voltage panel driving signal of the first sub-pixel in each array block; and a driving module, used for driving the glowing pixels in turn by the high luminance signal and the low luminance signal, and driving other first sub-pixels by the pixel signal.

10. The driving device according to claim 9, wherein relative positions between the glowing pixel and the other first sub-pixels in each array block are the same.

11. The driving device according to claim 10, wherein the block dividing module defines adjacent two of the first sub-pixels as one of the plurality of array blocks, and selects any one of the two adjacent first sub-pixels in the one of the plurality of array blocks as the glowing pixel.

12. The driving device according to claim 10, wherein the block dividing module defines adjacent four of the first sub-pixels as one of the plurality of array blocks, and selects any one of the four adjacent first sub-pixels in the one of the plurality of array blocks as the glowing pixel.

13. The driving device according to claim 9, wherein the block dividing module defines adjacent two of the first sub-pixels as one of the plurality of array blocks, and selects any one of the two adjacent first sub-pixels in the one of the plurality of array blocks as the glowing pixel.

14. The driving device according to claim 9, wherein the block dividing module defines adjacent four of the first sub-pixels as one of the plurality of array blocks, and selects any one of the four adjacent first sub-pixels in the one of the plurality of array blocks as the glowing pixel.

15. The driving device according to claim 9, wherein the block dividing module defines adjacent nine of the first sub-pixels as one of the plurality of array blocks, and selects one first sub-pixel located at a center of the one of the plurality of array blocks as the glowing pixel.

16. The driving device according to claim 15, wherein the calculating module adopts following formulas to calculate:

$$L=1*L5+0.8*(L2+L4+L6+L8)+0.4*(L1+L3+L7+L9);$$

$$H=1*H5+0.8*(H2+H4+H6+H8)+0.4*(H1+H3+H7+H9);$$

wherein L1, L3, L7, L9 represent four first sub-pixels' low voltage panel driving signals which are in the diagonal positions;

L2, L4, L6, L8 represent another four first sub-pixels' low voltage panel driving signals which are adjacent to the first sub-pixel located at a center of the one of the plurality of array blocks;

H1, H3, H7, H9 represent four first sub-pixels' high voltage panel driving signals which are in the diagonal positions;

H2, H4, H6, H8 represent another four first sub-pixels' high voltage panel driving signals which are adjacent to the first sub-pixel located at a center of the one of the plurality of array blocks;

L5 represents the glowing pixel's low voltage panel driving signal, L represents the low luminance signal which needs to be calculated;

H5 represents the glowing pixel's high voltage panel driving signal, H represents the high luminance signal which needs to be calculated.

17. A liquid crystal display, wherein, the liquid crystal display comprises a driving device of the liquid crystal display, the driving device of the liquid crystal display comprises a processor and a memorizer, the memorizer stores executable instructions, the processor executes the executable instructions, and the executable instructions comprises:

a block dividing module, used for dividing first sub-pixels of a display panel into a plurality of array blocks, and selecting at least one of the first sub-pixels in each array block as a glowing pixel;

a signal acquiring module, used for receiving an image to be displayed, and acquiring a pixel signal of a liquid crystal pixel of the display panel, and looking up a table for the liquid crystal pixel, so as to obtain a high voltage panel driving signal and a low voltage panel driving signal of each first sub-pixel;

a calculating module, used for calculating a high luminance signal and a low luminance signal, respectively, for driving the glowing pixel in the array block according to the high voltage panel driving signal and the low voltage panel driving signal of the first sub-pixel in each array block; and a driving module, used for driving the glowing pixels in turn by the high luminance signal and the low luminance signal, and driving other first sub-pixels by the pixel signal.

18. The liquid crystal display according to claim 17, wherein relative positions between the glowing pixel and the other first sub-pixels in each array block are the same.

19. The liquid crystal display according to claim 17, wherein the block dividing module defines adjacent two of the first sub-pixels as one of the plurality of array blocks, and selects any one of the two adjacent first sub-pixels in the one of the plurality of array blocks as the glowing pixel.

20. The liquid crystal display according to claim 17, wherein the block dividing module defines adjacent four of the first sub-pixels as one of the plurality of array blocks, and selects any one of the four adjacent first sub-pixels in the one of the plurality of array blocks as the glowing pixel.

* * * * *